US005795691A

United States Patent [19]

Yamazaki et al.

[11] Patent Number: 5,795,691

[45] Date of Patent: Aug. 18, 1998

[54] DEVELOPER FOR ELECTROSTATIC LATENT IMAGE DEVELOPMENT

[75] Inventors: Hiroshi Yamazaki; Kishio Tamura; Mayumi Hayashi, all of Toyko, Japan

[73] Assignee: Konica Corporation, Japan

[21] Appl. No.: 647,864

[22] Filed: May 14, 1996

[30] Foreign Application Priority Data

Sep. 1, 1995 [JP] Japan ..... 7-225206

[51] Int. Cl.[6] ..... G03G 9/083

[52] U.S. Cl. ..... 430/106.6; 430/108

[58] Field of Search ..... 430/106.6, 106, 430/108, 109

[56] References Cited

U.S. PATENT DOCUMENTS 5,314,777 5/1994 Watanabe et al. ..... 430/106.6

5,391,451 2/1995 Yoshie et al. ..... 430/106.6

5,447,813 9/1995 Hagiwara et al. ..... 430/106.6

*Primary Examiner*—John Goodrow

*Attorney, Agent, or Firm*—Bierman, Muserlian and Lucas LLP

[57] ABSTRACT

Disclosed is a developer of electrostatic latent image containing a carrier and a toner which contains a colorant and a binder resin, wherein the carrier comprises a magnetic substance particle and a resin coated on the magnetic substance particle, and said resin for coating is a polyolefin having a weight average molecular weight (Mw) of $20\times10^4$ to $100\times10^4$, a number average molecular weight (Mn) of $0.5\times10^4$ to $10\times10^4$ and an Mw/Mn of 5 to 100; and further the toner may contain a polyolefin having a number average molecular weight of 1500 to 9000 as a releasing agent.

18 Claims, 2 Drawing Sheets

DEVELOPER FOR ELECTROSTATIC LATENT IMAGE DEVELOPMENT

BACKGROUND OF THE INVENTION

1. Field of the Invention

The present invention relates to a developer for electrostatic latent image development used for an electrophotography method, an electrostatic photography method and an electrostatic printing method, and particularly relates to a developer for electrophotography providing stable images, which is free from the occurrence of fogging or toner scattering, even in the use for a long time.

2. Prior Art

As a developer used for an electrophotography method, there is commonly used a so-called two-component developer, composed of a toner and a carrier, which can be designed to separate a developing and fixing function and a function of charging and developer transport. As a carrier used in the foregoing, there are known a carrier wherein magnetic particles composed of ferrite or iron powder are used as such and a resin-coated carrier wherein the surface of the above-mentioned magnetic particle is coated with a resin. Among these, the resin-coated carrier is preferable from the viewpoint of easy control of charging and durability of the carrier.

Recently, in order to reduce waste in environment, there have been made various attempts for reducing the total amount of a developer by extending the life of the developer used in a copying machine.

In an attempt for extending the life, coating the surface of the magnetic particle with a resin has been proposed. For example, a technology to use a fluorine-containing resin and a technology, as described in Japanese Patent Application Open to Public Inspection (hereinafter, referred to as Japanese Patent O.P.I. Publication) No. 187770/1990, to use a resin of polymerized olefin have been proposed. In the above-mentioned technology of coating a fluorine-containing resin, the charging property of the resin is restricted. Therefore, only capability of providing specific charging property is obtained, providing only limited use. Consequently, the carrier coated with a polyolefin-containing resin is beneficial in terms of ability to control charging property.

In the case of a polyolefin resin, since a resin itself does not have a polar group, its water repellency and releasing property are excellent. Accordingly, when such a resin is applied to a carrier for electrophotography, durability of the carrier is excellent.

However, when the polyolefin is used as a resin for coating the carrier, plastic-deformation easily takes place due to the inherent property of the resin. Therefore, there have been caused new problems which were not observed in a conventional carrier.

First of all, a change in unevenness on the surface of the carrier varies the charging ability of the carrier. Consequently, when it is used for a long period of time, development performance of the developer is caused to be unstable.

In addition, it is common that fine particles are added onto the surface of a toner particle to provide fluidity and charging property. However, there occurs a phenomenon in which the above-mentioned fine particles, added onto the toner, are taken into the carrier-coating resin. This also results in the reduction of charging ability of the carrier and, when it is used for a long period of time, unstable development performance of the developer.

Due to the poor adhesive property of the polyolefin itself to a magnetic substance which is a core material of the carrier, a problem such as peeling of layers occurs, causing change of charging property, which is a cause of low quality image such as fogging and is a cause of toner scattering inside the apparatus.

As a method for fixing the toner, a heat fixing method is favorably used due to its simplicity. As the above-mentioned fixing method, a so-called heat roll fixing method and a film fixing method are known. In the above-mentioned methods, the toner, melted by means of heat, is brought into contact with a roll or a sheet of film. Therefore, in order to reduce adhering property of the toner in such portions, various releasing agents are used. Since the above-mentioned releasing agent is a soft material, it causes problems that it is isolated from the surface of the toner and adheres to the carrier so that the carrier is contaminated.

From the viewpoint mentioned above, a developer capable of forming a stable image for a long period of time is demanded.

SUMMARY OF THE INVENTION

An object of the present invention is to provide a developer for electrostatic latent image development which provides stable images, i.e., free from fogging and the occurrence of the toner scattering in the use over an extended period of time and a carrier for electrostatic latent image developing used with aforesaid developer.

The developer of the present invention will be described.

The developer contains a carrier wherein a resin is coated on magnetic substance particles and a toner. A resin used for coating the carrier is a polyolefin having a weight average molecular weight (Mw) of $20\times10^4$ to $100\times10^4$, a number average molecular weight (Mn) of $0.5\times10^4$ to $10\times10^4$ and an Mw/Mn of 5 to 100.

It is preferable that the resin for coating the carrier is a polyolefin having a weight average molecular weight (Mw) of $25\times10^4$ to $90\times10^4$, a number average molecular weight (Mn) of $1.0\times10^4$ to $8\times10^4$ and an Mw/Mn of 6 to 80.

The toner comprises a colorant and a binder resin. The toner preferably contains a releasing agent. This releasing agent is a low-molecular-weight polyolefin preferably having a number average molecular weight (Mn) of 1,500 to 9,000.

DESCRIPTION OF THE PREFERRED EMBODIMENTS

Carrier

Figure 1:
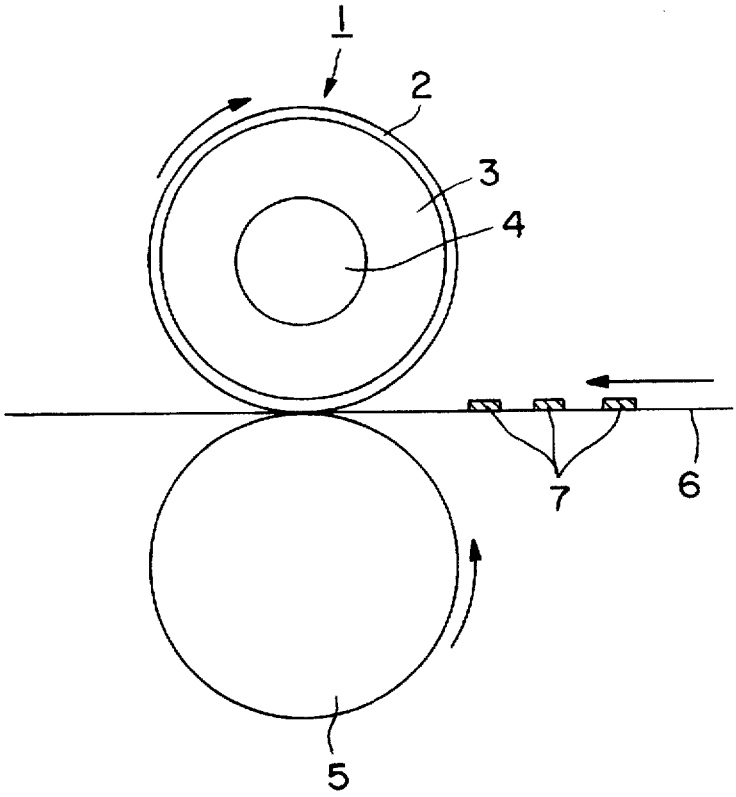
FIG. 1 is a schematic drawing showing an example of a heat roller fixing type apparatus.

In a carrier, magnetic substance particle is coated with a polyolefin. The resin for coating the magnetic substance particle is a polyolefin having a weight average molecular weight (Mw) of $20\times10^4$ to $100\times10^4$, a number average molecular weight (Mn) of $0.5\times10^4$ to $10\times10^4$ and an Mw/Mn is 5 to 100. It is preferable that the weight average molecular weight (Mw) is $25\times10^4$ to $90\times10^4$, the number average molecular weight (Mn) is $1.0\times10^4$ to $8\times10^4$ and the Mw/Mn is 6 to 80.

Here, when a resin coated carrier is used for a developer, in order to obtain preferable anti-abrasion property of layer and in order to retain sufficient charging property and thereby in order to be free from problems such as fogging, the weight average molecular weight of the resin for coating is $20\times10^4$ or more. On the other hand, in order to prevent the occurrence of layer abrasion, and to maintain favorable adhesivity of the layer itself and in order to prevent layer peeling, and thereby in order to maintain preferable charging property, the weight average molecular weight of the resin for coating is $100\times10^4$ or less. In addition, the number average molecular weight has a similar tendency as the weight average molecular weight. In order to have a suitable molecular weight distribution, to satisfy concurrently adhesivity and improvement in terms of hardness and to maintain durability, the value of Mw/Mn is 5 or more. In addition, for easy manufacture, the value of Mw/Mn is 100 or less.

When the above-mentioned molecular weight distribution is attained, objects of the present invention can satisfactorily be attained. More preferably, a Z average molecular weight Mz is controlled from $2\times10^5$ to $2\times10^7$ and Mz/Mw is controlled from 2 to 50. These can be attained by increasing the polymer amount on higher molecular weight.

For controlling the molecular weight distribution of a polyolefin, it is possible to use either a method wherein the molecular weight distribution of the resin itself is controlled by the kind or amount of a catalyst used for polymerization, polymerization temperature, polymerization time and pressure of a raw material monomer gas; or a method wherein resins having different molecular weight distribution from each other are combined to be used. Either method for obtaining the molecular weight of the present invention may be used.

As a monomer constituting the polyolefin, an aliphatic unsaturated hydrocarbon containing monomer such as ethylene, propylene, 1-butene, isobutylene, 1-octene, 1-pentene, 2-methyl-1-butene, 1-hexene, 1-nonene and 1-decene are preferable. In addition, resins or copolymers obtained from other vinyl-containing monomers can be used. However, polyethylene using ethylene as a monomer is preferable.

Magnetic particles which is used for the core of the carrier are not specifically restricted. Ferrite, magnetite and iron powder having a volume average particle size of 20 to 200 μm are preferable and 30 to 100 μm are more preferable.

As a magnetic particle which forms the core material of the carrier, those which are strongly magnetized in the direction of the magnetic field can be used. Practically, ferromagnetic metals such as iron, ferrite, magnetite, nickel and cobalt, and alloys or compounds containing the above-mentioned metals may be used. The surface of magnetic particle may be subjected to oxidation or reduction. Incidentally, ferrite referred to here is a general term of magnetic compounds containing iron, and is not limited to the spinel type.

The weight average particle size of the magnetic particle is preferably 40 to 90 μm.

As for the coating resin the coating weight of polyolefin is preferably 1 wt % to 20 wt %, more preferably 1.0 to 10.0 wt % and specifically more preferably 2.5 wt % to 8 wt % based on the weight of the magnetic substance particles. In order to sufficiently reduce shock regardless of the structure of a developing device, 1 wt % or more is preferable. In addition, in order to retain preferable image density, regardless of developing conditions (for example, potential and developing gap), by means of appropriate layer thickness and thereby appropriate resistance, 20 wt % or less is preferable.

In a resin which covers the carrier, functional fine particle materials such as conductive fine particles and charge controlling fine particles may be incorporated as necessary.

As a conductive fine particle, fine particles which can regulate the volume specific resistance of the carrier, by being incorporated, may be used. In practice, metal fine particles such as iron, aluminum and nickel, carbon black, conductive titania, silicon carbide, tin oxide and magnetite or their mixtures can be used.

As a charge controlling fine particle, inorganic or organic charge controlling fine particles can be used. As an inorganic charge controlling fine particle, fluorine-containing compounds such as fluorinated carbon and magnesium fluoride, metal oxides such as silicon oxide, titanium oxide, aluminum oxide and zinc oxide, calcium carbonate, barium titanate, aluminum silicate and magnesium silicate or their mixtures can be used. The surface of the above-mentioned charge controlling fine particles can be subjected to surface treatment with a coupling processing agent containing a polar group. As a coupling processing agent, fluorine-containing coupling agents and amine-containing coupling agents can be used. As an organic charge controlling fine particle, metal complex type azo-series compounds such as those using a metal of chromium or iron and fine particles of salicylic acid-containing compounds, copper phthalocyanine-containing compounds, calix allene-containing compounds, quaternary ammonium salt compounds, polyamine-containing compounds, triphenylmethane-containing compounds, guanidine-containing compounds, imidazole-containing compounds and molybdic acid chelate compounds can be used.

In addition, when the fine particles are incorporated in the coating resin, the average primary particle size of the fine particle is preferably 1/5000 to 1/50 of the weight average particle size of the carrier. The average primary particle size of the fine particle can easily be measured by means of electron microscope observation.

A method for controlling the molecular weight distribution of the coating resin is not specifically restricted, provided that it attains its object. Practically, depending upon the method of resin coating, one method is selected arbitrarily or plural methods are used in combination from a method wherein the activity degree of a polymerization catalyst is selected or controlled in such a manner that low molecular weight components do not occur when an olefin monomer which manufactures polyolefin is polymerized; a method wherein the low molecular weight components are removed in advance before the polyolefin is coated on the carrier; a method wherein the low molecular weight components are removed from the coated resin layer after the carrier is coated; and a method wherein a carrier is coated while the low molecular weight components are being removed.

Favorable results can be obtained by selecting a method wherein the low molecular weight components are removed by means of a solid-liquid extraction method, using a conventional means such as a Soxhlet extractor, under reflux by the use of a hydrocarbon-containing solvent such as n-hexane or toluene after the carrier was coated with a resin.

Here, the molecular weight distribution and the weight average molecular weight (Mw) of a polyolefin can be measured by means of Gel Permeation Chromatography (GPC).

In practice, GPC Model 150C (trade name, produced by WATERS Inc.) was used. As a solvent, o-dichlorobenzene (wherein butyl hydroxy toluene was added by 0.1 wt %) was used. Temperature was set to 135° C. and the measurement flow rate was set to 1.0 ml/minute. As a measurement sample, a sample solution of 0.1 wt % in terms of sample resin density was prepared, and 0.4 ml was injected into the measurement unit. The column in the measurement unit may be selected as necessary, and there is not limited thereto. For example, Shodex A-80M, HT-800P and HT-806M (all trade names, produced by Showa Denko) can be used. Impurities (components other than the coating resin such as functional fine particles added to the magnetic particles or the coating resin) which is generated when the sample solution is prepared should be removed prior to measurement by means of a metal sintering filter.

In addition, when measuring the sample, a calibration curve which has been prepared by means of several kinds of a mono-dispersed polystyrene and diphenylmethane in advance is used.

The number average molecular weight (Mn) can be measured by the conventionally used methods such as a freezing point method, a boiling point method and an osmotic pressure method and calculated by the following formula:

$$Mn=\Sigma MiNi/\Sigma Ni$$

wherein Mn represents a number average molecular weight, Mi represents a molecular weight of the molecule and Ni represents a number of the molecule.

Also, the Z average molecular weight (Mz) can be measured by a sedimentation equilibrium method (a refractive index method) using an ultracentrifugation or the GPC method as mentioned above by using the molecular weight of the respective molecules and subjecting to calculation using the following formula:

$$Mz=\Sigma Mi^3Ni/\Sigma Mi^2Ni$$

wherein Mz represents a Z average molecular weight, and Mi and Ni have the same meanings as defined above.

The content of the low molecular weight component whose molecular weight (Mw) is $8.5\times10^3$ or less is calculated as an area ratio from the resulting GPC chart.

According to the study, there is a correlation between the amount of the low molecular weight in the polyolefin which is a coating resin and easiness of plastic deformation on the carrier surface. The lower content of the low molecular weight component with the molecular weight (Mw) of $8.5\times10^3$ or less provides more inhibition of plastic deformation, and as a result, it is preferable because the performance of carrier can be stabilized for a long period of time.

Practically, there is a correlation between the content ratio of the low molecular weight component with molecular weight (Mw) of $8.5\times10^3$ or less of a polyolefin coating the carrier and easiness of plastic deformation at the carrier surface. When it is 10 wt % or less of the total polyolefin, favorable results can be obtained. In addition, when it is 5 wt % or less, more preferable results were obtained. The above-mentioned value may be 0%.

As a coating method of the carrier, it is possible to use any of conventionally known various coating methods such as a spray coating method wherein polyolefin is dissolved in a suitable solvent and spray-coated onto the surface of magnetic particles; a method wherein polyolefin powder is caused to be adhered on the surface of magnetic particles and is mechanically fixed while heating at a melting point of the resin material or higher; and a surface polymerization coating method described in Japanese Patent O.P.I. Publication No. 106808/1985.

In the surface polymerization method, for example, a catalyst capable of polymerizing the above-mentioned monomer is carried on the surface of the magnetic substance particle core, aforesaid monomer is incorporated in a non-aqueous solvent, polymerization reaction is conducted on the surface of aforesaid particle and thereby a polyolefin-coated layer is formed. In order to manufacture the carrier of the present invention, the above-mentioned method is preferably used. As the above-mentioned catalyst, Ziegler-Natta catalyst is usually used. The present inventors assume that the reason why the carrier coated by means of the surface polymerization method is preferable is that the resulting polyolefin has excellent adhesion property with the core particles.

If mechanical stress is applied to the surface of the carrier after the low molecular weight components of the carrier-coating resin are removed in order to close the minute cavities which occurred on the surface and inside the carrier and smoothen the surface, the performance of the developer can be further enhanced. For providing the mechanical stress, conventional mixers, granulating machines and crushers can be used. Practically, Mechano-mill (produced by Okada Seiko), Henschel Mixer (produced by Mitsui Mineral Co., Ltd.), Vertical Granulator (produced by Powlec Co., Ltd.), Hybridizer (produced by Nara Kikai Seisakusho) and Mechano Fusion System (produced by Hosokawa Micron Co., Ltd.) can be used. In addition, the surface of the carrier from which the low molecular weight components were removed is difficult to receive plastic deformation. Therefore, when conducting the above processing, it is preferable to heat the carrier at 50° to 150° C.

It is preferable that the volume specific resistance of the carrier is $1.0\times10^8$ to $5.0\times10^{14}$ Ω cm, and it is more preferable to be $1.0\times10^9$ to $1\times10^{14}$ Ω cm.

Here, the measurement method of the volume specific resistance of the carrier will be described. About 1.0 g of carrier is filled in an insulated cylindrical container whose cross section is 1.0 $cm^2$. After the height of the sample was measured under a load of 500 g, an electric field of DC 100V was impressed so that the electric current value is measured. From the resulting height of the sample and the electric current value, the volume specific resistance can be calculated according to the following equation.

$$\text{Volume specific resistance value } (\Omega\text{cm})=100(V)\cdot\text{cross section } (cm^2)/\text{electric current value } (A)\cdot\text{height of sample (cm)}$$

Toner and developer

Toner comprises a binder resin, a colorant and other additives used as necessary. Its average particle size is preferably 1 to 30 μm, and more preferably 5 to 20 μm in terms of a volume average particle size. The binder resin constituting the toner is not specifically restricted. Conventionally known various resins are used. For example, styrene type resins, acrylic type resins, styrene/acrylic type resins and polyester resins are cited.

The colorant constituting the toner is not specifically limited. Various conventional materials may be used. For example, carbon black, nigrosine dye, aniline blue, charcoal blue, chrome yellow, ultramarine blue, Du Pont oil red, quinoline yellow, methylene blue chloride, phthalocyanine blue, Malachite green oxalate and Rose Bengal are cited.

In addition to the above, as an additive usable as necessary, charge controlling agents, releasing agents such as polyolefin wax and natural wax, magnetic powder and dispersion aids of the above-mentioned additives can be used.

Manufacturing method of the toner is also not restricted. Practically, a crushing method wherein constituting materials are mixed, melted and kneaded, and then, to a chilling step, classified for obtaining the toner and a polymerization method wherein toner is obtained by the use of emulsification polymerization and suspension polymerization may be used.

It is preferable that the toner contains a releasing agent. As a releasing agent used in the toner, a low molecular weight polyolefin is preferable. It was discovered that, as the constituting component of the toner which adheres on the carrier, the releasing agent is the main component. When the low molecular weight polyolefin is stuck on the carrier coated with the polyolefin resin, since their charging properties are almost the same, charging properties of them in themselves are not changed even when adherence occurs. Therefore, when the low molecular weight polyolefin is used as a releasing agent, even over a long period of time, and even when the constituting components of the toner is stuck on the carrier, there is no charging properties of the carrier to the toner, stable charging properties can be maintained and no image defects such as fogging occur.

As a low molecular weight polyolefin used as the releasing agent, polypropylene or copolymers of propylene and ethylene can be used. In such occasions, polypropylene is specifically preferable.

In the measurement method of the molecular weight, number average molecular weight using a high temperature GPC is applied to. Practically, it is a number average molecular weight wherein o-dichlorobenzene to which 0.1% of ionol is added is used as a solvent, the low molecular weight polyolefin is flowed out at 135° C., it is sensed by means of a differential refraction index detector and the molecular weight is calculated in conversion to the polypropylene absolute molecular weight in accordance with a universal calibration method.

Manufacturing method of the low molecular weight polyolefin used as the releasing agent is not specifically restricted. Ordinarily, a method wherein polyolefin synthesized by means of a conventional method is subjected to heat decomposition or pyrolysis under melting state is cited. Specifically, for adjustment of the molecular weight, there is a method to sample in such a manner as to make a preferable molecular weight in the above-mentioned GPC.

The above-mentioned molecular weight is ordinarily 1500 to 9000 and preferably 2000 to 8500 in terms of the number average molecular weight. In order to prevent excessive isolation from the toner surface, in order to have an appropriate softness and in order not to harm stabilizing of charging properties, the above-mentioned molecular weight is preferably 1500 or more. In addition, in order for the releasing agent to provide its performance, suitable number average molecular weight is preferable.

In order to maintain fluidity of the toner and in order to provide offset-preventing effect in fixing, the added amount of the polyolefin in the toner is preferably 0.5 to 5.0 wt % and more preferably 1.0 to 4.0 wt % of the resin.

As other additives, charge controlling agents such as salicylic acid derivatives and azo type metal complex are cited.

In addition, from a viewpoint of providing fluidity, inorganic fine particles may be added. As an inorganic fine particle, inorganic oxide particles such as silica, titania and alumina are preferable. In addition, the above-mentioned inorganic fine particles are preferably processed to be made hydrophobic by the use of a silane coupling agent or a titanium coupling agent.

In order to prepare a two-component developer, a toner and a carrier are mixed. It is preferable that the toner is mixed with the carrier so that an amount of the toner in a developer may be 2 to 10 wt %.

Weight average particle size of a toner and a magnetic particle can be measured by the use of a laser refraction type graininess distribution measuring apparatus HELOS (trade name, produced by Synpatec).

Development method adopted to the present invention is not specifically restricted.

Fixing method

Preferable fixing methods used in the present invention include (1) a heat roll fixing method and (2) a heat film fixing method that is a fixing method wherein toner images are heated and fixed on a recording material by the use of a heating material fixedly mounted and a pressure member which faces aforesaid heating material to be in pressure contact therewith and rotates to bring the recording material to be in pressure contact with the heating material through a film member.

The heat roller fixing method will now be explained by referring to FIG. 1. There is provided an upper roller 1 having a heating source 4 inside a metallic cylinder 3, which is constituted by iron or aluminum, whose surface 2 is coated with tetrafluoroethylene or a polytetrafluoroethylene-perfluoroalkyl vinyl ether copolymer, and there is also provided a lower roller 5 formed by silicone rubber. Specifically, the upper roller 1 has a line heater as the heating source 4 so that the temperature of the surface of the upper roller 1 is heated to about 110° to 220° C. Between this upper roller 1 and the lower roller 5, a recording member 6 which carries a toner image 7 of the present invention is passed through so that the toner image 7 is heat-melting fixed onto the recording member. In the above-mentioned heat roller fixing method, it is commonly conducted that, at the fixing unit, pressure is provided between the upper roller 1 and the lower roller 5 so that the lower roller 5 is deformed. Accordingly, the so-called "nip" is formed. The nip width is ordinarily 1 to 10 mm, and preferably 1.5 to 7 mm. Fixing speed is preferably 40 to 500 mm/sec. When the nip width is too small, heat cannot be provided to toner uniformly so that uneven fixing easily occur. To the contrary, when the nip width is too large, fusion of the toner is promoted so that fixing offset becomes excessive.

The heat film fixing method will now be explained by referring to FIG. 2. A line-shaped heating material 15, with low heat capacity, is fixed and supported on an apparatus. Electric current is passed at both ends of the low heat capacity line-shaped heating material 15 wherein an electric resistance material is coated at thickness of 1.0 to 2.5 mm on an alumina board whose thickness is 0.2 to 5.0 mm and preferably 0.5 to 3.0 mm, the width is 10 to 15 mm and the length is 240 to 400 mm. An electric current of DC 100 V is flowed through the low heat capacity line-shaped heating materials 15 in the form of a pulse of 25 msec. in frequency in such a manner that the pulse width is modulated in accordance with a required amount of energy on the basis of the temperature measured by a temperature sensor 16. Provided that temperature, sensed at the low heat capacity line-shaped heating material 15, by means of the temperature sensor 16 is T1, surface temperature T2 of the film member 14 which faces the resistance material is lower than T1. Here, T1 is preferably 110° to 220° C. The temperature of T2 is preferably lower than that of T1 by 0.5° to 10° C.

Surface temperature T3 of the film member at a point where film member 14 is peeled off from the surface of the fixed toner is almost equivalent to T2. In the above-mentioned manner, the film member, after being brought into contact with the heated material whose energy and temperature are controlled, moves toward the same direction as a recording member. The above-mentioned film member 14 is a heat-durable film, preferably an endless film, whose thickness is 10 to 35 μm, made of polyester, polyperfluoroalkyl vinyl ether, polyimide and polyether imide, coated with a releasing agent layer, whose thickness is 5 to 15 μm, wherein at least a conductive material is added to a fluorine resin such as Teflon. Ordinarily, film member 14, whose total thickness is 10 to 100 μm, is conveyed toward the arrowhead direction due to the driving and tension by means of a driving roller 11 for the film member and a driven roller 12 for the film member without wrinkle or crumpling. The fixing speed is preferably 40 to 500 mm/sec. A pressure roller 13 has an elastic rubber layer having high releasing property such as silicone rubber. It provides a total pressure of 2 to 30 kg to low heat capacity line-shaped heating material 15 through film member 14. The above-mentioned pressure member rotates in the arrowhead direction while pressing the line-shaped heating material. By passing the recording member, which carries the toner image, between the above-mentioned film member 14 and the pressure roller 13, and thereby the recording member is passed between them with low heat capacity line-shaped heating material 15, the toner image is caused to be molten-fixed onto the recording member.

Another example of the heat film fixing method will be explained by referring to FIG. 3. While an example in FIG. 2 uses an endless sheet as a film member 14, FIG. 3 shows an example of using a double-ending film member 24. Namely, as shown in FIG. 3, on a sheet feeding shaft 21 and a winding shaft 22, a film member 24 is rolled. With fixing, the film member is moved in an arrowhead direction little by little. In this occasion, the film member 24 is driven by means of a winding shaft 22. Numerals 13, 15, 16 and 17 are identical to those in FIG. 2.

The double-ending film member 24, which is wound in a sheet feeding shaft 21 due to driving of the winding shaft 22 is drawn little by little with fixing. Between this double-ending film member 24 and a pressure roller 13, the recording material which carries the toner image is passed through so that low heat capacity line-shaped heating material 15 is passed. Thus, the toner images are molten-fixed onto the recording member.

In any of the above-mentioned systems, fixing and cleaning mechanisms are provided to be used. The above systems include a method wherein a fluorine-containing silicone oil is supplied to upper roller 1 in the fixing apparatus or a film and a method wherein a pad, a roller or a web in which a fluorine-containing silicone oil is impregnated is used for cleaning.

It is provided a carrier which solves poor adhesiveness of a polyolefin itself on magnetic substance particles and thereby forms stable images for a long period of time while maintaining a function, which polyolefin in itself has, to be able to prevent adhesion of a toner, and a developer using the same.

The aforesaid problem is solved by setting the molecular weight distribution of polyolefin (Mw, Mn) and Mw/Mn to the range of the present invention for improving adhesivity between the polyolefin itself and magnetic particles. By the use of the low molecular weight components, wettability on the magnetic substance can be improved. However, only due to this, since a resin in itself is soft, durability in itself is reduced. On the other hand, the high molecular weight components can increase the harness of the resin in itself. Therefore, when it is used as carrier, durability can be improved. However, wettability on the magnetic substance is reduced so that adhesive property of the layer is reduced.

In order to satisfy both superior issues concurrently, the molecular weight distribution (Mw and Mn) and Mw/Mn ratio are selected.

EXAMPLES

Example 1

Example of manufacturing carrier

In an autoclave, 500 ml of hexane subjected to dehydrate and 450 g of dried magnetic particles (ferrite whose volume average particle size was 60 μm), and the mixture was stirred. Following this, 2.0 mmol of Ziegler-Natta catalyst was added to the above-mentioned resulting mixture for stirring so that the catalyst was caused to be carried on the surface of the magnetic substance particles. Next, the total pressure was set to 6.0 kg/cm$^2$G, and then, ethylene gas was continuously supplied at 90° C. and reacted with the mixture for 45 minutes so that ethylene was polymerized on the surface of the magnetic substance particle for obtaining carrier coated with the polyethylene resin. This is defined to be "carrier 1". In addition, pressure, reaction temperature and reaction time were changed for obtaining carriers shown below. Incidentally, the molecular weight distribution was measured under the following conditions.

Apparatus: Gel Permeation Chromatograph Model 150C (trade name, produced by WATERS Inc.)

Column: Shodex HT-800P and HT-806M (trade names, the inner diameter was 8.0 mm and the length was 30 cm) (2 pcs) Theoretical step was 25800 steps (produced by Showa Denko)

Solvent: o-dichlorobenzene (wherein 0.1% of butyl hydroxy toluene was added)

Flow rate: 1.0 ml/min.

Temperature: 135° C.

Detector: Differential refraction index detector

TABLE 1

| Carrier No | Mw | Mn | Mz | Mw/Mn | Mz/Mw |
|---|---|---|---|---|---|
| Carrier 1 | $25 \times 10^4$ | $1.0 \times 10^4$ | $121 \times 10^4$ | 25.0 | 4.8 |
| Carrier 2 | $41 \times 10^4$ | $2.8 \times 10^4$ | $165 \times 10^4$ | 15.2 | 4.0 |
| Carrier 3 | $65 \times 10^4$ | $1.1 \times 10^4$ | $210 \times 10^4$ | 59.1 | 3.2 |
| Carrier 4 | $87 \times 10^4$ | $6.5 \times 10^4$ | $455 \times 10^4$ | 13.4 | 5.2 |
| Carrier 5 | $89 \times 10^4$ | $9.1 \times 10^4$ | $665 \times 10^4$ | 9.8 | 7.5 |
| Comparative carrier 1 | $19 \times 10^4$ | $0.9 \times 10^4$ | $105 \times 10^4$ | 21.1 | 5.5 |
| Comparative carrier 2 | $43 \times 10^4$ | $13 \times 10^4$ | $185 \times 10^4$ | 3.3 | 4.3 |
| Comparative carrier 3 | $102 \times 10^4$ | $9.8 \times 10^4$ | $655 \times 10^4$ | 10.4 | 6.4 |
| Comparative carrier 4 | $23 \times 10^4$ | $0.4 \times 10^4$ | $102 \times 10^4$ | 57.5 | 4.4 |

Evaluation

By the use of the above-mentioned carriers, 100 parts of styrene and 8 parts of carbon black were mixed, melted, kneaded, crushed and classified so that toners, whose volume average particle size is 8.1 μm, wherein 0.8 wt % of hydrophobic silica was added to the resulting colored particles and developers wherein the toner density was 6.0 wt % were prepared. These were defined to be "Developer 1" to "Developer 5" and "Comparative developer 1" to "Comparative developer 4".

By the use of the above-mentioned developers, copying of 100,000 sheets were conducted continuously under high temperature and high humidity (33° C., 80%RH (relative humidity)) using U-BIX3135 (trade name), produced by Konica, employing a layer-lamination type organic photoreceptor. Fogging densities at initial stage and after 100,000 sheets copying were measured. The following Table shows the results thereof.

Incidentally, the fogging density was represented by relative reflection density by the use of a Macbeth densitometer wherein the density of a paper was defined to be 0. In addition, for determining the degree of the occurrence of toner scattering, contamination inside the copying machine was visually evaluated.

TABLE 2

| Developer No. | Fogging density Initial | After 100,000 copies | Contamination inside the copying machine |
|---|---|---|---|
| Developer 1 | 0.000 | 0.002 | not existed |
| Developer 2 | 0.000 | 0.001 | not existed |
| Developer 3 | 0.000 | 0.001 | not existed |
| Developer 4 | 0.000 | 0.001 | not existed |
| Developer 5 | 0.000 | 0.001 | not existed |
| Comparative developer 1 | 0.000 | 0.018 | existed |
| Comparative developer 2 | 0.000 | 0.022 | existed |
| Comparative developer 3 | 0.000 | 0.021 | existed |
| Comparative developer 4 | 0.000 | 0.032 | existed |

The above-mentioned results illustrate that the developers of the present invention using the carrier of the present invention provides, compared with the comparative samples, superior effects wherein fogging is little even after using over time and fogging due to the scattering of toner does not occur.

Example 2

Carriers prepared in Example 1 and toners illustrated as follows were combined.

Polypropylene prepared by a conventional method was subjected to heat decomposition so that low molecular weight polypropylenes having a number average molecular weight respectively shown in the following Table 2 were obtained. This low molecular weight polypropylene was used by 8 parts, to which 100 parts of a styrene-acrylic resin and 8 parts of carbon black were mixed. The mixture was melted, kneaded, crushed and classified so that toners shown in the following Table 3, whose average particle size was 8.1 μm, wherein 0.8 wt % of hydrophobic silica was added to the resulting colored particles, were obtained.

TABLE 3

| Toner No. | Number average molecular weight of a releasing agent |
|---|---|
| Toner 1 | 2100 |
| Toner 2 | 3200 |
| Toner 3 | 4100 |

TABLE 3-continued

| Toner No. | Number average molecular weight of a releasing agent |
|---|---|
| Toner 4 | 6600 |
| Toner 5 | 7300 |
| Toner 6 | 8400 |
| Comparative toner 1 | 1200 |
| Comparative toner 2 | 11000 |

By the use of the above-mentioned carriers and the above-mentioned toners, developers, shown in the following Table 4, wherein toner density was 6% were prepared. As a comparative carrier, carrier wherein a styrene-acrylic resin was coated on the carrier, i.e., "Comparative carrier 5" was used.

TABLE 4

| Developer No. | Toner No. | Carrier No. |
|---|---|---|
| Developer 1 | Toner 1 | Carrier 1 |
| Developer 2 | Toner 2 | Carrier 2 |
| Developer 3 | Toner 3 | Carrier 3 |
| Developer 4 | Toner 4 | Carrier 4 |
| Developer 5 | Toner 5 | Carrier 5 |
| Developer 6 | Toner 6 | Carrier 2 |
| Developer 7 | Toner 3 | Carrier 4 |
| Developer 8 | Toner 4 | Carrier 5 |
| Comparative developer 1 | Comparative toner 1 | Carrier 1 |
| Comparative developer 2 | Comparative toner 2 | Comparative carrier 1 |
| Comparative developer 3 | Comparative toner 1 | Comparative carrier 2 |
| Comparative developer 4 | Comparative toner 1 | Comparative carrier 3 |
| Comparative developer 5 | Comparative toner 1 | Comparative carrier 4 |
| Comparative developer 6 | Toner 1 | Comparative carrier 5 |

By the use of the above-mentioned developers, copying of 100,000 sheets were conducted continuously under high temperature and high humidity (35° C., 85%RH) using Model 3135 (trade name), produced by Konica, employing a layer-lamination type organic photoreceptor. Fogging densities at initial stage and after 100,000 sheets copying were measured. The following shows the results thereof. Incidentally, the fogging density was represented by relative reflection density by the use of a Macbeth densitometer wherein the density of a paper was defined to be 0.

As a fixing apparatus, the below-mentioned heat roll fixing apparatus and heat film fixing apparatus were used.

Heat roll fixing conditions

In the heat roll method, there was a 30 mm (diameter) upper roller, whose surface was coated with a tetrafluoroethylene-perfluoroalkyl vinyl ether copolymer, composed of cylindrical iron, integrally housing a heater in its central portion and there was also a 30 mm (diameter) lower roller constituted of silicone rubber whose surface was coated with a tetrafluoroethylene-perfluoroalkyl vinyl ether copolymer. Line pressure was set at 0.8 kg/cm, and nip width was 4.3 mm. By the use of the above-mentioned fixing machine, the copying line speed was set at 250 mm/sec. As the cleaning mechanism of the fixing machine, a mechanism wherein a pad in which a silicone oil was impregnated is brought into contact with the fixing roll was used. The fixing temperature was 180° C. FIG. 1 shows the above-mentioned system.

Heat film fixing conditions

Figure 2:
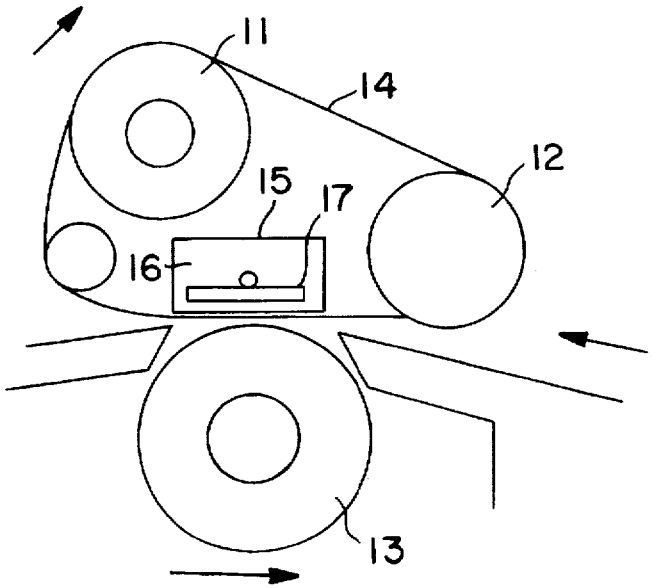
FIG. 2 is a schematic drawing showing an example of a heat film fixing type apparatus.
Figure 3:
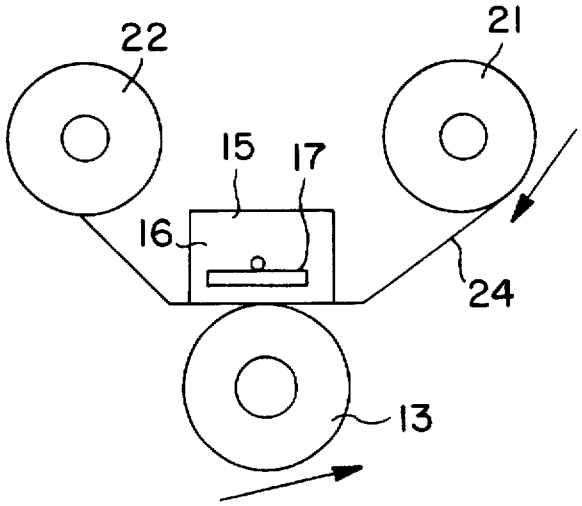
FIG. 3 is a schematic drawing showing another example of a heat film fixing type apparatus.

As the fixing apparatus, a fixing machine of an endless film type shown in FIG. 2 was used. The fixing conditions were set as follows.

Fixing conditions:

Temperature of a heating material T1=180° C.

Speed of the film material=250 mm/sec.

Total pressure between the heating material and the pressure roller=15 kg

Nip width between the pressure roller and the film material=3 mm

The film material: a polyimide film material, coated with polytetrafluoroethylene wherein conductive material was dispersed on its surface, whose thickness was 15 μm.

As the cleaning mechanism of the fixing machine, in the same manner as in the heat roll fixing method, a pad in which a silicone oil was impregnated was provided and used.

TABLE 5

| Developer (Toner I) | Heat roll fixing method Fogging density Initial | Heat roll fixing method Fogging density After 100,000 sheets | Heat film fixing method Fogging density Initial | Heat film fixing method Fogging density After 100,000 sheets |
|---|---|---|---|---|
| Developer 1 | 0.000 | 0.002 | 0.000 | 0.002 |
| Developer 2 | 0.000 | 0.001 | 0.000 | 0.001 |
| Developer 3 | 0.000 | 0.001 | 0.000 | 0.001 |
| Developer 4 | 0.000 | 0.001 | 0.000 | 0.001 |
| Developer 5 | 0.000 | 0.002 | 0.000 | 0.002 |
| Developer 6 | 0.000 | 0.002 | 0.000 | 0.002 |
| Developer 7 | 0.000 | 0.001 | 0.000 | 0.001 |
| Developer 8 | 0.000 | 0.002 | 0.000 | 0.002 |
| Comparative developer 1 | 0.000 | 0.011 | 0.000 | 0.011 |
| Comparative developer 2 | 0.000 | 0.018 | 0.000 | 0.018 |
| Comparative developer 3 | 0.000 | 0.022 | 0.000 | 0.022 |
| Comparative developer 4 | 0.000 | 0.021 | 0.000 | 0.021 |
| Comparative developer 5 | 0.000 | 0.022 | 0.000 | 0.022 |
| Comparative developer 6 | 0.000 | 0.012 | 0.000 | 0.012 |

Table 5 illustrates that the developers of the present invention provide no fogging and are excellent in durability.

Example 3

Manufacturing Example of Toner

| Toner I | |
|---|---|
| Styrene/n-butyl methacrylate copolymer resin (Softening point: 132° C., Glass transition point: 60° C.) | 100 parts by weight |
| Carbon black (MA#8, trade name, produced by Mitsubishi Kasei Corporation) | 8 parts by weight |
| Low molecular weight polypropylene (Biscol 550P, trade name, produced by Sanyo Kasei Co., Ltd.) Mn = 3000 | 5 parts by weight |
| Charge controlling agent (TP-302, trade name, produced by Hodogaya Kagaku Co., Ltd.) | 3 parts by weight |

After the above-mentioned materials were sufficiently mixed in a ball mill, the resulting mixture was fused and kneaded by the use of a three roll heated to 140° C. After the kneaded material was left and thereby chilled, it was subjected to coarse crushing by the use of a feather mill, and then, subjected to fine crushing by the use of a jet mill. Following this, the resulting material was subjected to air separation for obtaining colored particles of an average particle size of 7.0 μm.

Following this, to the color particles, 0.5 wt % of hydrophobic silica fine particles (H-2050EP, trade name, produced by Hoechst AG) and 0.4 wt % of titania fine particles (TAF-510, trade name, produced by Fuji Titan Co., Ltd.) were added and mixed for obtaining Positive toner I.

| Toner II | |
|---|---|
| Polyester resin (Tuftone NE-382, trade name, produced by Kao Corporation) | 100 parts by weight |
| Brilliant Carmin 6B (C.I. 15850) | 3 parts by weight |
| Natural wax (Refined carnauba wax No. 1, produced by Noda Wax Co., Ltd.) | 3 parts by weight |
| Charge controlling agent (E-84, trade name, produced by Orient Chemical Co., Ltd.) | 5 parts by weight |

From the above-mentioned materials, in the same manner as in the manufacturing example of Toner I, the colored particles of an average particle size of 7.5 μm was obtained.

Following this, to the color particles, 0.5 wt % of hydrophobic silica fine particles (R-974, trade name, produced by Japan Aerojil Co., Ltd.) and 0.3 wt % of hydrophobic titania fine particles (T-805, trade name, produced by Japan Aerojil Co., Ltd.) were added and mixed for obtaining Negative toner II.

Manufacturing Example of Carrier

Carrier A

In an autoclave, 500 ml of dehydrated n-hexane and 450 g of magnetic particles (Cu—Zn ferrite, the weight average particle size of 60 μm) which had been evacuated for drying in advance were inserted and stirred. To the mixture, 2.0 mmol of Ziegler-Natta catalyst was added for stirring so that the catalyst was carried on the surface of the magnetic particles.

Next, from a nozzle located at above the autoclave, 0.22 g of carbon black (Ketchen Black EC, produced by Lion Aczo Co., Ltd.) was supplied. Incidentally, as the carbon black, one, which had been evacuated for drying in advance, was mixed with dehydrated n-hexane for being in slurry state was used.

Following this, pressure was added, and then, an ethylene gas was continuously supplied for 50 minutes at heated temperature of 90° C. so that the ethylene was subjected to polymerization reaction on the surface of the magnetic particles for obtaining polyethylene-coated carrier A.

When the molecular weight distribution of the resin which covers carrier A was measured, the weight average molecular weight Mw was 380,000, and the low molecular weight components of $8.5\times10^3$ or less was 12.6 wt %.

Carrier B

In the same manner as in the manufacturing example of Carrier A except that 0.5 g of conductive fine particles (T-1, trade name, produced by Mitsubishi Material, the average primary particle size of 0.1 μm) in place of carbon black, polyethylene-coated carrier B was obtained.

When the molecular weight distribution of the resin which covers carrier B was measured, the weight average molecular weight Mw was 350,000, and the low molecular weight components of $8.5\times10^3$ or less was 13.8 wt %.

Carrier C

In the same manner as in the manufacturing example of Carrier A except that carbon black was not supplied, polyethylene-coated carrier C was obtained.

When the molecular weight distribution of the resin which covers carrier C was measured, the weight average molecular weight Mw was 420,000, and the low molecular weight components of $8.5\times10^3$ or less was 12.0 wt %.

Carrier D

In the same manner as in the manufacturing example of Carrier A except that the kind of Ziegler-Natta catalyst was changed and magnetite (the weight average particle size of 55 μm) was used as a magnetic particle, polyethylene-coated carrier D was obtained.

When the molecular weight distribution of the resin which covers carrier D was measured, the weight average molecular weight Mw was 170,000, and the low molecular weight components of $8.5\times10^3$ or less was 16.2 wt %.

Carrier 1

Carrier A was subjected to solid-liquid extraction for the low molecular weight components under n-hexane reflux by the use of the Soxhlet extractor for 10 minutes for obtaining Carrier 1.

Carriers 2–5

Carrier A through D were subjected to solid-liquid extraction for the low molecular weight components under n-hexane reflux by the use of the Soxhlet extractor for 60 minutes for obtaining Carriers 2 through 5.

Carriers 2+–5+

Carriers 2 to 5, which had been subjected to the solid-liquid extraction, were respectively supplied to a Mechanomill (produced by Okada Seiko Co., Ltd.) and stirred at the stirring fan rotation number of 2000 rpm at the heated temperature of 80° C. for providing mechanical stress onto the surface of the carriers. The above-mentioned processing was conducted for 60 minutes for obtaining Carriers 2+ to 5+.

The following Table shows the results of measuring the molecular weight distribution of each carrier.

TABLE 6

| | Resin coating ratio (weight %) | Weight average molecular weight | Content of low molecular weight component of $8.5\times10^3$ or less (weight %) | Volume specific resistance (Ωcm) |
|---|---|---|---|---|
| Carrier A | 4.0 | 380,000 | 12.6 | $2\times10^{12}$ |
| Carrier B | 3.9 | 350,000 | 13.8 | $1\times10^{10}$ |
| Carrier C | 4.0 | 420,000 | 12.0 | $3\times10^{14}$ |
| Carrier D | 5.8 | 170,000 | 16.2 | $3\times10^{12}$ |
| Carrier 1 | 5.8 | 380,000 | 8.5 | $2\times10^{12}$ |
| Carrier 2 | 3.6 | 390,000 | 1.5 | $2\times10^{12}$ |
| Carrier 3 | 3.6 | 360,000 | 1.8 | $8\times10^{9}$ |
| Carrier 4 | 3.5 | 420,000 | 2.4 | $2\times10^{14}$ |
| Carrier 5 | 5.2 | 180,000 | 2.8 | $3\times10^{12}$ |
| Carrier 2+ | 3.6 | 390,000 | 1.5 | $3\times10^{12}$ |
| Carrier 3+ | 3.6 | 360,000 | 1.8 | $9\times10^{9}$ |
| Carrier 4+ | 3.5 | 420,000 | 2.4 | $4\times10^{14}$ |
| Carrier 5+ | 5.2 | 180,000 | 2.8 | $2\times10^{12}$ |

To each of the above-mentioned carrier, the positive charge toner I was mixed in such a manner that the toner density will be 6 wt % for preparing developers A through D and 1 through 5. Each developer was respectively supplied to a copying machine U-Bix 4155 (trade name, produced by Konica Corporation), and copying of 50,000 sheets at high temperature and high humidity (30° C. and 80%RH) and of 50,000 sheets at low temperature and low humidity (10° C. and 20%RH) were conducted in a one-sheet intermittent mode (totally, 100,000 sheets). The resulting sheets were subjected to the following evaluation.

Image density

An original wherein a fully black image of an original reflection density of 1.30 was set on five points, i.e., four corners and the central portion of the resulting sheets was copied and the relative reflection density of the output image against a white paper was measured at the five portions, and their average value was calculated. Incidentally, for density measurement, a reflective densitometer RD-917 (trade name, produced by Macbeth Inc.) was used. The average value of the image density of 1.28 or more was evaluated to be favorable. In addition, evaluation was conducted at the initial stage of copying and after the end of copying.

Background fogging density

Relative reflection density of 5 points of non-image portions in total, i.e. four corners and the central portion of the resulting sheets against a white paper was measured, and their average value was calculated. Incidentally, for density measurement, a reflective densitometer RD-917 (produced by Macbeth Inc.) was used. The average value of the background fogging density of 0.005 or less was evaluated to be favorable. In addition, evaluation was conducted at the initial stage of copying and after the end of copying.

Change of carrier surface state

Before and after the end of copying, each developer was sampled up from inside the developing device so that the change of the situation of the surface of the resin-coated layer of the carrier was compared by the use of a scanning type electron microscope (SEM). It was evaluated that the smaller change provides higher stability and better results.

TABLE 7

| | | Image density | | Background fogging density | | Change of |
|---|---|---|---|---|---|---|
| Developer (Toner I) | Carrier used | Initial | After 100,000 sheets | Initial | After 100,000 sheets | carrier surface state |
| Developer 1 | Carrier 1 | 1.32 | 1.25 | 0.002 | 0.05 | Slightly deformed |
| Developer 2 | Carrier 2 | 1.32 | 1.30 | 0.001 | 0.003 | Almost stable |
| Developer 3 | Carrier 3 | 1.35 | 1.32 | 0.001 | 0.005 | Almost stable |
| Developer 4 | Carrier 4 | 1.32 | 1.30 | 0.001 | 0.004 | Almost stable |
| Developer 5 | Carrier 5 | 1.33 | 1.31 | 0.001 | 0.004 | Almost stable |
| Developer 2+ | Carrier 2+ | 1.33 | 1.34 | 0.001 | 0.001 | Stable |
| Developer 3+ | Carrier 3+ | 1.36 | 1.35 | 0.001 | 0.000 | Stable |
| Developer 4+ | Carrier 4+ | 1.33 | 1.35 | 0.001 | 0.000 | Stable |
| Developer 5+ | Carrier 5+ | 1.32 | 1.33 | 0.001 | 0.001 | Stable |

To each of the above-mentioned carrier, the negative charge toner II was mixed in such a manner that the toner density will be 6 wt % for preparing developers 2+ through 5+ and 1 through 5. Each developer was respectively supplied to a copying machine U-Bix 6192 (produced by Konica Corporation), and copying of 50,000 sheets at high temperature and high humidity (30° C. and 80%RH) and of 50,000 sheets at low temperature and low humidity (10° C. and 20%RH) were conducted in a one-sheet intermittent mode (totally, 100,000 sheets). The resulting sheets were subjected to the evaluation identical to the evaluation of Table 7.

TABLE 8

| Developer (Toner II) | Carrier used | Image density Initial | Image density After 100,000 sheets | Background fogging density Initial | Background fogging density After 100,000 sheets | Change of carrier surface state |
|---|---|---|---|---|---|---|
| Developer 1 | Carrier 1 | 1.33 | 1.24 | 0.001 | 0.05 | Slightly deformed |
| Developer 2 | Carrier 2 | 1.33 | 1.31 | 0.001 | 0.004 | Almost stable |
| Developer 3 | Carrier 3 | 1.36 | 1.31 | 0.001 | 0.004 | Almost stable |
| Developer 4 | Carrier 4 | 1.32 | 1.30 | 0.001 | 0.005 | Almost stable |
| Developer 5 | Carrier 5 | 1.33 | 1.30 | 0.001 | 0.004 | Almost stable |
| Developer 2+ | Carrier 2+ | 1.34 | 1.35 | 0.001 | 0.000 | Stable |
| Developer 3+ | Carrier 3+ | 1.36 | 1.35 | 0.001 | 0.000 | Stable |
| Developer 4+ | Carrier 4+ | 1.33 | 1.34 | 0.001 | 0.001 | Stable |
| Developer 5+ | Carrier 5+ | 1.33 | 1.34 | 0.001 | 0.001 | Stable |

As shown above, the present invention can provide a developer for electrostatic latent image development wherein deformation on the surface of the carrier-coating resin is inhibited and more stable development properties are exhibited over a long period of time, by removing the low molecular weight components in polyolefin, which is a carrier-coating resin, down to the level of 10 wt % or less from a developer composed of the toner and the carrier.

Owing to the present invention, solves problems of change of the form of carrier surface, fogging due to using over a long period of time and toner scattering which occur in a developer using a polyolefin-coated carrier are solved, and a developer for electrostatic latent image development which provides stable developing characteristics for a long time can be offered.

Owing to the developer of the present invention, an electrostatic latent image development method capable of obtaining stable development properties for a long period of time even when the developer is used at a high speed copying machine or under any adverse condition can be obtained.

We claim:

1. A two component developer of electrostatic latent image containing a carrier and a toner which contains a colorant and a binder resin, wherein said carrier comprises a magnetic substance particle and a resin coated on the magnetic substance particle, and said resin for coating is a polyolefin having a weight average molecular weight (Mw) of $20\times10^4$ to $100\times10^4$, a number average molecular weight (Mn) of $0.5\times10^4$ to $10\times10^4$ and an Mw/Mn of 5 to 100.

2. The developer of claim 1, wherein the resin for coating is a polyolefin having a weight average molecular weight (Mw) of $25\times10^4$ to $90\times10^4$, a number average molecular weight (Mn) of $1.0\times10^4$ to $8\times10^4$ and an Mw/Mn of 6 to 80.

3. The developer of claim 1, wherein the resin for coating is a polyolefin having a Z average molecular weight Mz is from $2\times10^5$ to $2\times10^7$ and Mz/Mw is from 2 to 50.

4. The developer of claim 1, wherein the resin for coating is composed of an aliphatic unsaturated hydrocarbon containing monomer.

5. The developer of claim 4, wherein the monomer is selected from the group consisting of ethylene, propylene, 1-butene, isobutylene, 1-octene, 1-pentene, 2-methyl-1-butene, 1-hexene, 1-nonene and 1-decene.

6. The developer of claim 5, wherein the monomer is ethylene.

7. The developer of claim 1, wherein the resin for coating is contained in an amount of 1 wt % to 20 wt % of the magnetic substance particle.

8. The developer of claim 7, wherein the amount of the resin for coating is 2.5 wt % to 8 wt % of the magnetic substance particle.

9. The developer of claim 1, wherein the resin for coating is formed by polymerizing a monomer on the surface of the magnetic substance particle.

10. The developer of claim 1, wherein the toner contains a releasing agent.

11. The developer of claim 1, wherein the toner is contained in an amount of 2 to 10 wt % of the developer.

12. The developer of claim 10, wherein the releasing agent is a polyolefin having a number average molecular weight of 1500 to 9000.

13. The developer of claim 12, wherein the releasing agent is a polyolefin having a number average molecular weight of 2000 to 8500.

14. The developer of claim 10, wherein the releasing agent is a polypropylene or a copolymer of propylene and ethylene.

15. A two component developer of electrostatic latent image containing a carrier and a toner which contains a colorant and a binder resin, wherein the carrier comprises a magnetic substance particle and a resin coated on the magnetic substance particle, said resin for coating is a polyolefin having a weight average molecular weight (Mw) of $25\times10^4$ to $90\times10^4$, a number average molecular weight (Mn) of $1.0\times10^4$ to $10\times10^4$ and an Mw/Mn of 5 to 100, and contained in an amount of 1 wt % to 20 wt % of the magnetic substance particle, and the toner contains a polyolefin having a number average molecular weight of 1500 to 9000 as a releasing agent.

16. The developer of claim 2 wherein said magnetic substance particle has a volume average particle size of 30 to 100 μm.

17. The developer of claim 15 wherein the resin for coating is comprised of an ethylene monomer.

18. The developer of claim 15 wherein said resin for coating is formed by polymerizing a monomer on the surface of said magnetic substance particle.

* * * * *